United States Patent [19]

Mitarai et al.

[11] 4,437,377

[45] Mar. 20, 1984

[54] DIGITAL ELECTRONIC MUSICAL INSTRUMENT

[75] Inventors: Tsuyoshi Mitarai, Yokohama; Kunio Sato, Tokyo, both of Japan

[73] Assignee: Casio Computer Co., Ltd., Tokyo, Japan

[21] Appl. No.: 370,088

[22] Filed: Apr. 20, 1982

[30] Foreign Application Priority Data

Apr. 30, 1981 [JP] Japan ..... 56-66220
Apr. 30, 1981 [JP] Japan ..... 56-66221

[51] Int. Cl.[3] ..... G10H 1/00

[52] U.S. Cl. ..... 84/1.01; 84/1.26; 84/1.27; 84/1.13; 84/1.24

[58] Field of Search ..... 84/1.01, 1.26, 1.27, 84/1.24, 1.13; 179/15.55 R, 1 VL; 381/104, 106

[56] References Cited

U.S. PATENT DOCUMENTS

| | | | |
|---|---|---|---|
| 3,809,788 | 5/1974 | Deutsch | 84/1.01 |
| 3,809,790 | 5/1974 | Deutsch | 84/1.01 |
| 3,888,153 | 6/1975 | Deutsch | 84/1.01 |
| 3,992,970 | 11/1976 | Chibana et al. | 84/1.11 |
| 3,992,971 | 11/1976 | Chibana et al. | 84/1.03 |
| 4,205,577 | 6/1980 | Deutsch | 84/1.26 X |
| 4,227,433 | 10/1980 | Chibana | 84/1.01 |
| 4,253,367 | 3/1981 | Hiyoshi et al. | 84/1.24 X |
| 4,256,003 | 3/1981 | Deutsch | 84/1.01 |
| 4,301,704 | 11/1981 | Nagai et al. | 84/1.27 X |
| 4,333,376 | 6/1982 | Moore et al. | 84/1.27 |
| 4,343,218 | 8/1982 | Futamase | 84/1.01 |
| 4,344,343 | 8/1982 | Deforett | 84/1.01 |

FOREIGN PATENT DOCUMENTS

| | | |
|---|---|---|
| 2617573 | of 0000 | Fed. Rep. of Germany . |
| 3023559 | of 0000 | Fed. Rep. of Germany . |
| 1575721 | 9/1980 | United Kingdom . |
| 1580690 | 12/1980 | United Kingdom . |

OTHER PUBLICATIONS

Chamberlin, Advanced Real-Time Music Synthesis Techniques, Byte, Apr. 1980, pp. 86, 88, 90.

*Primary Examiner*—F. W. Isen
*Attorney, Agent, or Firm*—Frishauf, Holtz, Goodman & Woodward

[57] ABSTRACT

A digital musical tone signal is generated in a first LSI selected by a chip select signal transferred from a CPU in accordance with a control signal transferred through a control bus from the CPU. Amplitude data and envelope data are transferred from a second LSI to the first LSI through data lines. In the first LSI, the digital musical tone signal amplitude- and envelope-controlled is transferred to an A/D converter where it is converted into an analog musical tone signal.

10 Claims, 6 Drawing Figures

DIGITAL ELECTRONIC MUSICAL INSTRUMENT

BACKGROUND OF THE INVENTION

The present invention relates to a digital musical instrument with a plurality of musical tone generating circuits for digitally composing digital musical tone data generated from the musical tone generating circuits.

In recent years, electronic musical instruments for generating or forming musical tones using digital technology have been put to practical use. In the instrument of this type having a plurality of musical tone generating circuits for composing the output signals from those circuits, the output signals are passed through a digital to analog (D/A) converter and are mixed in an analog fashion. In the musical tone generating circuit comprises a circuit of the type which generates a single musical tone and a circuit of another type which generates a plurality of musical tones in a time division manner. This type of the musical tone generating circuit needs a plurality of D/A converters, resulting in increase of hardware and manufacturing cost. In this respect, this type of circuit is not best suited for manufacturing compact electronic musical instruments.

For generating a chord in an electronic digital musical instrument, for example a digital electronic keyboard instrument, a sound volume changes in accordance with the number of keys depressed. In an extreme case, a ratio of a single sound to a chord of eight sounds, for example, is 1:8. In expressing the eight times sound volume information in a digital notation, bits for expressing the eight-sound chord are by 3 bits larger than those for the single tone. When the D/A converter of 12 bits is applied for the eight-sound output signal, the single tone is expressed by only the lower 9 bits, and not using the upper three bits. This results in a great deterioration of sound quality.

Conversely, when the single sound is expressed by 12 bits, the digital expression of the chord is necessarily accompanied by an overflow. To avoid this, it is necessary to use a D/A converter for each sound or to use a D/A converter of 15 bits for expressing the chord of 8 sounds.

When the D/A converter is provided for each sound in the digital electronic musical instrument having the plurality of tone generating circuits, the manufacturing cost is increased, the size of the system is increased, and therefore it is impossible to render the musical instrument compact. It is not preferable to use the multibit input D/A converter of 15 bits, for example, for the same reasons that 12 bits (corresponding to 72 dB of the dynamic range) are enough to express musical tone signals of the electronic musical instrument, and the use of the multibit input type D/A converter deteriorates its converting accuracy and increases its manufacturing cost.

SUMMARY OF THE INVENTION

Accordingly, an object of the present invention is to provide a digital electronic musical instrument with a wide dynamic range which is low in cost, compact in size, and excellent in sound quality.

According to the present invention, there is provided a digital electronic musical instrument with a plurality of musical tone generating circuits, in which the musical tone generating circuits produce digital musical tone data, the musical tone data are digitally composed, and the composed data is converted into an analog signal by a single D/A converter.

In the present invention, the digital musical tone data obtained from the plurality of musical tone generating circuits are composed. Digital envelope data derived from the plurality of the musical tone generating circuits are composed. The composed musical tone data is compressed or expanded on the basis of the composed envelope data. Then, the data is converted into an analog signal by means of a D/A converter. The analog signal is amplified (expanded or compressed) on the basis of the envelope data. This data processing produces the original musical tone signal.

DETAILED DESCRIPTION OF THE PREFERRED EMBODIMENTS

Figure 1:
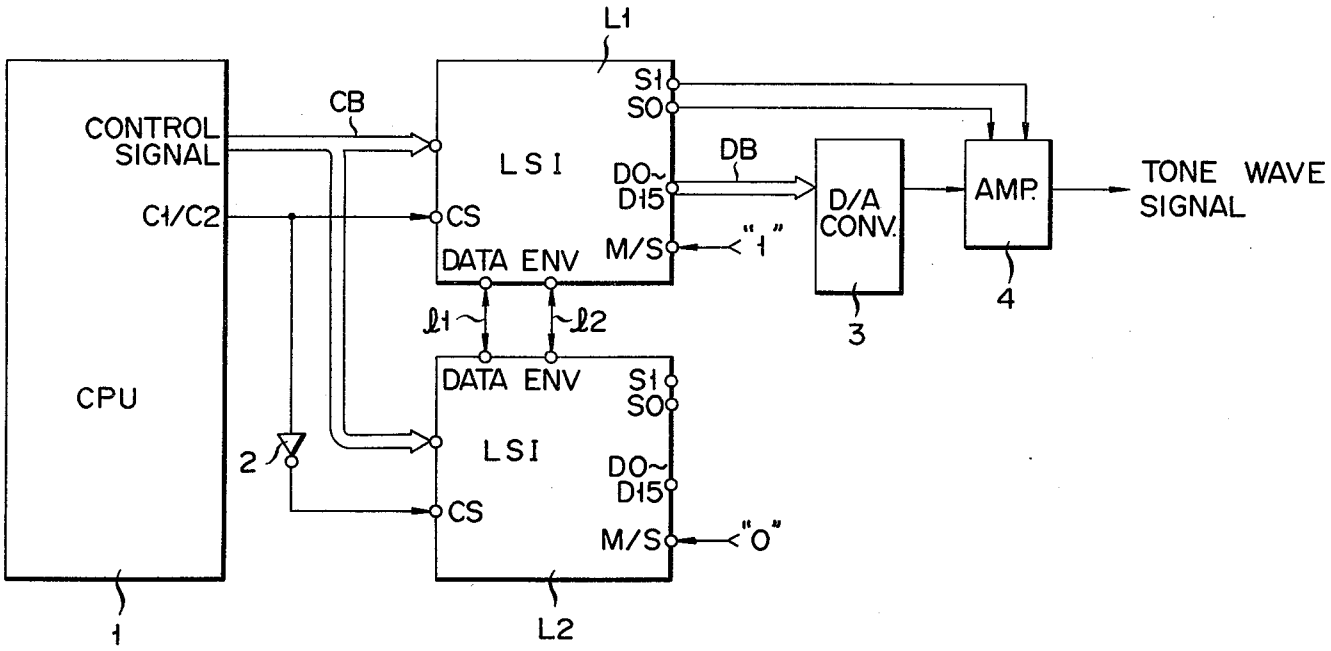
FIG. 1 is a block diagram showing an arrangement of an embodiment of a digital electronic musical instrument according to the present invention.

Referring to FIG. 1, there is illustrated a circuit arrangement of an embodiment of a digital electronic musical instrument according to the present invention. In the figure, reference numeral 1 designates a CPU constituted of a microprocessor. Externally operating signals representing data of musical tone to be formed (which specifies pitch, timbre and the like) are inputted to the CPU by means of external switches and key switches. The data is supplied through a control bus CB to a couple of large scale integrated circuits (LSIs) L1 and L2. the LSIs L1 and L2 are each fabricated by one chip. The CPU 1 supplies a chip select signal C1/C2 to terminals CS of the LSIs L1 and L2. The chip select signal C1/C2 going to the LSI L2 is inverted by an inverter 2 before it reaches the LSI L2. When the chip select signal C1/C2 is "1" in logical level, the LSI L2 is selected, if it is "0".

The LSIs L1 and L2 have exactly the same circuit constructions and each is capable of forming musical tone of a maximum of four chords musical tones through a time-division processing. Any type of the musical tone forming methods using the digital technology thus far developed may of course be applied for the present invention. The LSIs L1 and L2 each employ a circuit arrangement of a sinusoidal wave composing type in which one music tone includes five overtones. Accordingly, each of LSIs L1 and L2 can compose sinusoidal waves of 20 (=5 harmonics×four chords). A digital electronic musical tone generating system disclosed in U.S. patent application Ser. No. 324,466 filed on Nov. 24, 1981 may be used.

Data, i.e. amplitude data, and envelope data from the LSI L2 is transferred in serial to the LSI L1, through bidirectional lines l1 and l2. When a "1" signal is applied to the master/slave M/S terminal of the LSI, the LSI serves as a master, when a "0" signal is applied to the M/S terminal, the LSI serves as a slave. In the present embodiment, the LSI L1 serves as a master and the LSI L2 as a slave. In operation, data from the LSI L1 as the master is transferred to the LSI L2 as the slave where the data from the master L1 and the data formed in the slave L2 are composed.

Accordingly, the amplitude data of 16 bits, for example, (i.e. data formed by composing eight chords maximum, or 40 sinusoidal waves) are bit-shifted on the basis of the envelope data to be described later and are outputted from the terminals D0 to D15 of the LSI L1.

The LSI L1 further produces 2-bit data to determine an amplification factor through the terminals S0 and S1.

The digital data outputted from the terminals D0 to D15 is converted, by a D/A converter 3, into a voltage signal which in turn is applied to an amplifier 4. The voltage signal is amplified with a set amplification factor by the amplifier 4.

A practical arrangement of an essential part of the LSI L1 will be described in detail referring to FIGS. 2A and 2B. An arrangement of the LSI L2 is exactly the same as that of the LSI L1 and hence no explanation of the LSI L2 will be given. Locations of some terminals of the circuit shown in FIG. 2 do not correspond to those in the FIG. 1 circuit, for simplicity of explanation.

In the LSI L1, the amplitude data of four chords maximum (the sum of a maximum of four chords of the amplitude data envelope-controlled) d0 to d14 are generated by the time-division processing, and are applied to the transfer gates G1 to G15, respectively. A "0" signal is always applied to the transfer gate G16. The transfer gate G1 to G16 are enabled by a timing signal t15 to be described later to allow their output signals to latch circuits 11 to 26. Amplitude values of the musical tone are changed every timing signal t15.

The latch circuits 11 to 26 perform a fetching operation in response to a clock $\phi$1 (to be described later). The latch circuits 11 to 26 fetch the output signals from the transfer gates G1 to G16 at a time point that the timing signal t15 is "1", as described above. At the timings t0 to t14, the latch circuits fetch the output signals from the upper bit latches 12 to 26 and an output signal from a full adder 27, through transfer gates G17 to G32. The timing signal t15 is applied, as a gate signal, to the transfer gates G17 to G32, via an inverter 28. Accordingly, at the timings t0 to t14, the transfer gates G17 to G32 are enabled.

The output signal D0 from the latch 11 is applied to the terminal B of the latch 11. Serial data supplied from the LSI L2 through a data input terminal DATA of the LSI L1 connected to the line l1 is applied through an AND gate 29 to the terminal A of the full adder 27.

When the LSI L1 serves as the master, the AND gate 29 is enabled with impression of the "1" signal. When the LSI L1 functions as the slave, the "0" signal is applied to the AND gate 29, and the gate is disabled. Since the AND gate 29 is so operated, the output signal from the LSI L2 is supplied to the full adder 27 in the LSI L2.

On the other hand, in the LSI L2, the corresponding AND gate 29 is disabled. In this case, the master/slave signal inverted by the inverter 30 is supplied to the transfer gate G33, so that the transfer gate G33 is enabled and the output signal D0 from the latch 11 is outputted through the terminal DATA.

One of the input terminals of the AND gate 29 and an input terminal of the transfer gate G33 are set at a ground level ("0" level) through a resistor R1.

The terminal DATA connected to the line l1 is used as an input terminal in the LSI L1 but it is used as an output terminal in the LSI L2.

Accordingly, in the full adder 27 in the LSI L1, the musical data generated in the LSI L1 and the musical data generated in the LSI L2 are serially added every bit and the added one is applied to the latch 26 through the transfer gate G32.

A carry signal is produced from the carry output terminal COUT of the full adder 27 and applied to a latch 32 through an AND gate 31. The output signal from an inverter 28 is supplied to the AND gate 31 and is enabled at the timings t0 to t14. The latch circuit 32 performs the fetching operation in response to the clock $\phi$1. The output signal from the latch circuit 32 is applied to a carry input terminal CIN of the full adder 27.

In this way, the musical tone data generated by the LSI L1 and the musical tone data generated by the LSI L2 are summed by the full adder 27. The summed data from the full adder 27 is latched in the latches 11 to 26 and then are transferred in parallel to the latches 33 to 48 at the timing of the clock $\phi$16 (to be described later) where these are latched.

The output signals from the latches 33 to 48 are applied to latches which perform the fetching operation in response to the clock $\phi$L (to be described later), through transfer gates G34 to G49. The timing signal t15 is applied to the gates of the transfer gates G34 to G49. In response to the timing signal t15, the contents of the latches 33 to 48 are transferred to the latches 49 to 64. In response to the timing signals other than the signal t15, the transfer gates G50 to G64 connected to the output terminals of the latches 49 to 64 are enabled to allow the contents to be applied to the input terminals of the upper bit latches 50 to 64. The timing signal t15 inverted by an inverter 65 is applied to the gates of the transfer gates G50 to G64.

The musical tone data supplied from the latch circuits 33 to 48 in response to the clock $\phi$L is shifted to the upper bit, that is to say, compressed, and outputted to the latch circuits 66 to 81.

The latches 66 to 81 respond to the clock $\phi$16 to perform a fetch operation and supply the fetched signals to the terminals D0 to D15. The output signal from the latch 81 corresponding to the most significant bit, or a code bit, is inverted by an inverter 82 and applied to the output terminal D15. The arithmetic operation of the waveforms is base sound on the 2's complement operation. In the latches 66 to 81, a maximum level (positive) is "01 . . . 1"; a zero level "0 . . . 0"; a minimum level (negative) "10 . . . 01". By using the inverter 82, a linear output characteristic is obtained. In other words, the maximum level is "11 . . . 1", the zero level (ground level) "10 . . . 0", the minimum level "00 . . . 01".

The composing circuit of the envelope data will be described. In the LSI L1, the amplitude data of the musical tone and the envelope data of four chords maximum are composed and applied to the transfer gates G65 to G71. In adding the envelope data, the original envelope data are added as they are intact or only the upper bits of the data are added. In the present embodiment, the addition data of the envelope data up to four chords is expressed by 7 bits (E0 to E6). The envelope data are used for generating the amplitude data d0 to d14 of the musical tone, although not shown. Each musical tone is formed by multiplying the amplitude data of its original waveform and the envelope data at that time.

The timing signal t15 is applied, as a gate signal, to the transfer gates G65 to G71 and the transfer gate G72. When receiving the timing signal t15, the gates are enabled to allow the envelope data to be supplied to latches 83 to 90. A "0" signal is applied to the transfer gate G72.

The latches 83 to 90 respond to the clock $\phi 2$ (to be described later) to perform the fetching operation. When the timing signal t15 is "1" in logical level, the latches fetch the output signals from the transfer gates G65 to G72. At the timings t0 to t14, the latches fetch the output signals from the upper bits of the latches 84 to 90 and the addition output signal from a full adder 91, through the transfer gates G73 to G80. The timing signal t15, inverted by an inverter 92, is applied, as a gate signal, to the transfer gates G73 to G80. Accordingly, at the timings t0 to t14, the transfer gates G73 to G80 are enabled.

In connection with the full adder 91, the output signal E0 from the latch 83 is applied to the input terminal B of the full adder 91. Serial data coming through an envelope data input terminal ENV (connected to the line l2) is applied through an AND gate 93 to the input terminal A.

When the LSI L1 is in a master mode, the AND gate 93 is enabled with the impression of a "1" signal. Conversely, when it is in a slave mode, the AND gate 93 is disabled with the impression of a "0" signal. Accordingly, in the LSI L1, the output signal from the LSI L2 is supplied to the full adder 91, through the AND gate 93.

In the LSI L2, the corresponding AND gate 93 is disabled. However, since the master/slave signal inverted by the inverter 94 is applied to the transfer gate G81, so that the transfer gate G81 is enabled and the output signal E0 of the latch 83 is outputted through the terminal ENV.

One of the input terminals of the AND gate 93 and the input terminal of the transfer gate G81 are set at the ground level ("0" level), through a resistor R2.

The terminal ENV connected to the line l2 is used as an input terminal in the LSI L1, while it is used as an output terminal in the LSI L2. Accordingly, in the full adder 91 in the LSI L1, the envelope data generated in the LSI L1 and the envelope data generated in the LSI L2 are serially added bit by bit and the added one is applied to the latch 90 through the transfer gate G80.

A carry signal is outputted from the carry output terminal COUT of the full adder 91 and is applied to the latch 96 through the AND gate 95. The output signal from the inverter 92 is applied to the AND gate 95 which is enabled at the timings of the signals t0 to t14. The latch 96 performs the fetching operation in response to the clock $\phi 2$ and its output signal is applied to the carry input terminal CIN of the full adder 91.

In this way, the envelope data generated by the LSI L1 and the envelope data generated by the LSI L2 are added by the full adder 91. The result of the addition is latched in the latches 83 to 90 and then the upper 3 bits are latched in parallel in latches 97 to 99 at the timing of the clock $\phi 16$.

The output signals from the latches 97 to 99 are inputted to a decoder 103, directly and through inverters 100 to 102. The decoder 103 is constituted of a NOR matrix. Relationships between the output signals at the output lines m1 to m6 of the decoder 103 and the contents of the latches 99 to 98 are listed in Table 1.

TABLE 1

| Contents of latches 97 to 99 | m1 | m2 | m3 | m4 | m5 | m6 |
|---|---|---|---|---|---|---|
| 0 0 0 | 1 | 0 | 0 | 0 | 0 | 0 |
| 0 0 1 | 0 | 1 | 0 | 0 | 1 | 0 |
| 0 1 x | 0 | 0 | 1 | 0 | 0 | 1 |
| 1 x x | 0 | 0 | 0 | 1 | 1 | 1 |

In Table 1, symbol × indicates "0" or "1". The output signals from the lines m1 to m4 are applied to one of the input terminals of each of AND gates 104 to 107. The output signals from OR gates 108 to 110 and the timing signal t15 are supplied to the AND gates 104 to 107, respectively. The timing signals t0, t1, t2 and t15 are applied to the OR gate 108; the timing signals t0, t1 and t15 to the OR gate 109; the timing signals t0 and t15 to the OR gate 110. The output signals from the OR gates 104 to 107 are supplied to an OR gate 111 which in turn is outputted as the clock signal $\phi L$ through an AND gate 112. A clock signal $\phi 1$ is applied to one end of the AND gate 112.

The clock signal $\phi L$ outputted through the AND gate 112 is as shown in Table 2.

TABLE 2

| Contents of latches 97 to 99 | Clock $\phi L$ output timings |
|---|---|
| 0 0 0 | t15, t0, t1, t2 |
| 0 0 1 | t15, t0, t1 |
| 0 1 x | t15, t0, |
| 1 x x | t15, |

The data outputted through the lines m5 and m6 from the decoder 103 is inputted into latches 113 and 114 at the timing of the clock $\phi 16$. The output signals from the latches 113 and 114 are applied through the terminals S0 and S1 to the amplifier 4 (FIG. 1) to determine an amplification factor thereof. The amplification factors determined by the output signals at the terminals S1 and S0 are listed below.

TABLE 3

| Outputs at terminals S1 and S0 | Amplification factor |
|---|---|
| 0 0 | x 1 |
| 0 1 | x 2 |
| 1 0 | x 4 |
| 1 1 | x 8 |

Figure 3:
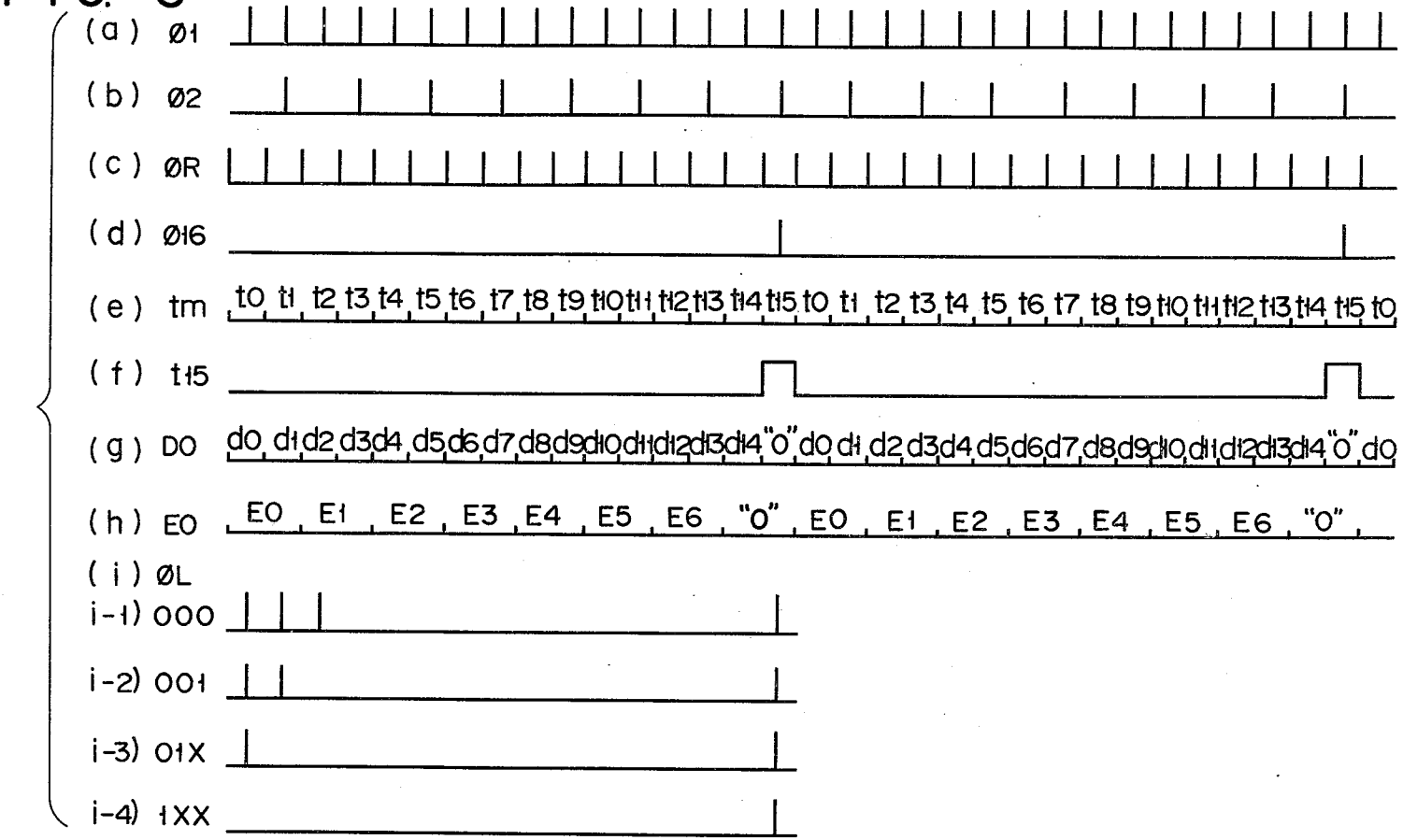
FIG. 3 is a timing chart illustrating the operation of the embodiment shown in FIGS. 1, 2A and 2B.

The operation of the present embodiment will be described referring to FIG. 3 illustrating clock and timing signals supplied to the electronic musical instrument of the embodiment. The write operation to the latches 11 to 26 and 32 is executed by the clock $\phi 1$ shown in FIG. 3(*a*). The write operation to the latches 83 to 90 and 96 are performed by the clock $\phi 2$ shown in FIG. 3(*b*). The fetch operation of all the latches including the just-mentioned ones are executed in synchronism with the clock $\phi R$ shown in FIG. 3(*c*).

Figure 2A:
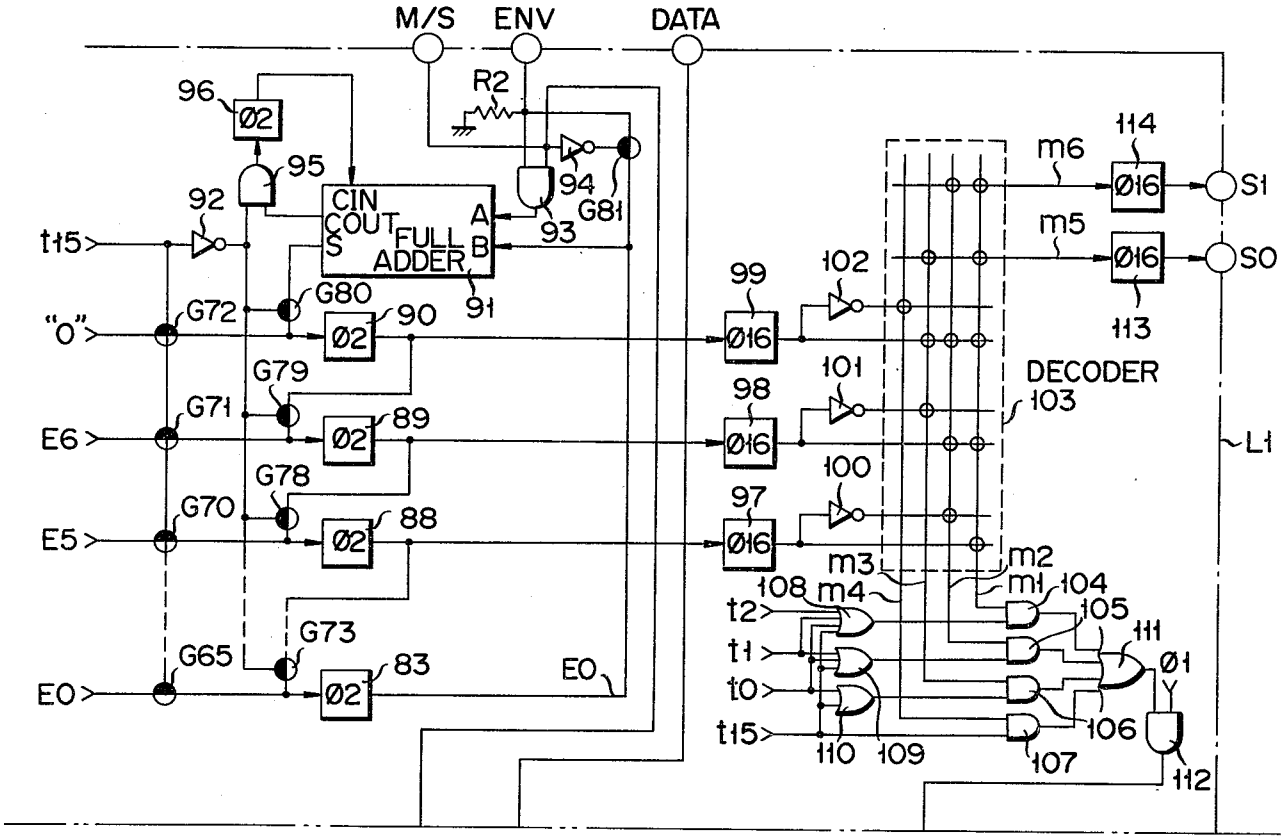
FIGS. 2A and 2B are block diagrams showing an arrangement of the LSI in FIG. 1.
Figure 2B:
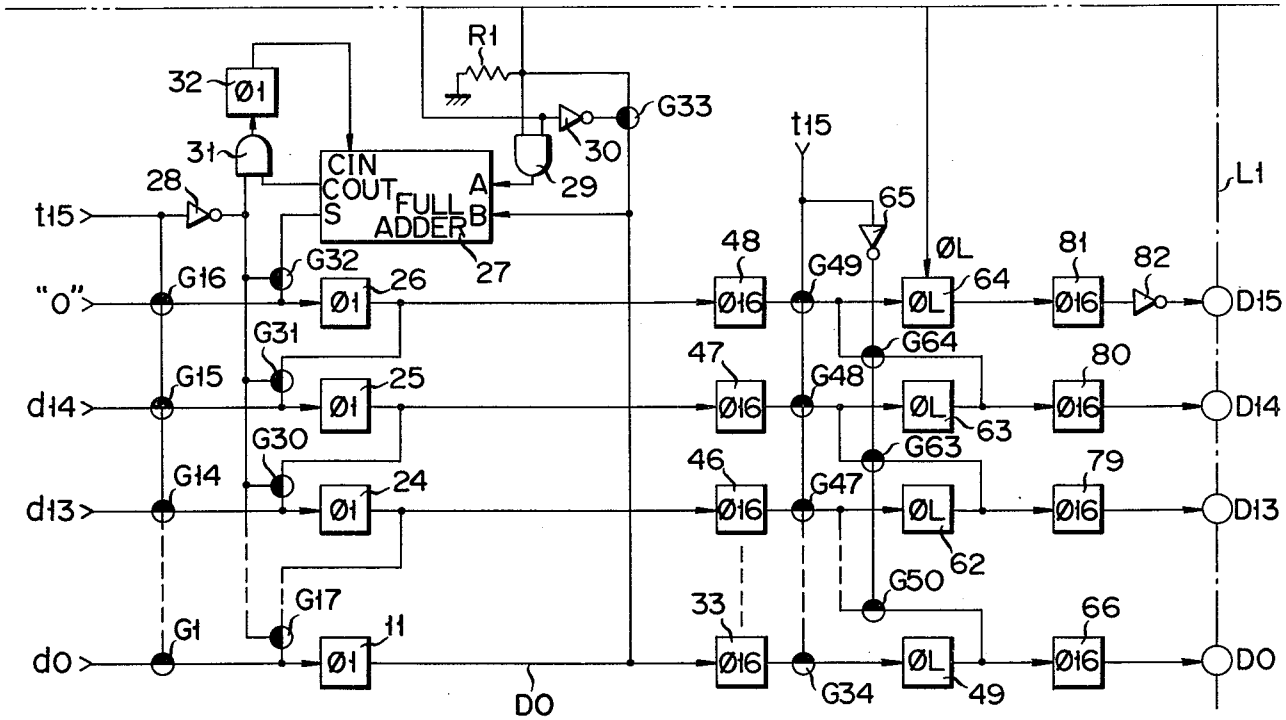

The circuits shown in FIGS. 2A and 2B operate with a basic cycle of t0 to t15 (see FIG. 3(*e*)). The composite data of the amplitude data of the musical tones and the composite data of the envelope data are determined before the timing t15.

Accordingly, at the timing t15 (see FIG. 3(*f*)), in both the LSIs L1 and L2, the transfer gates G1 to G16 and G65 to G72 are enabled and the data are transferred to and latched in the latches 11 to 26 and 83 to 90 at timings of the clock $\phi 1$ and clock $\phi 2$, respectively.

At the timings t0 to t14, the contents of the latches 11 to 26 are sequentially transferred from their lower bit to higher bit to the full adder 27 and the transfer gate G33, in synchronism with the clock $\phi$1. The contents of the latches 83 to 90 are sequentially transferred from their lower bit to higher bit to the full adder 91 and the transfer gate G81, in synchronism with the clock $\phi$2.

In the LSI L1, the transfer gates G33 and G81 are disabled, and the AND gates 29 and 93 are enabled. In the LSI L2, the transfer gates G33 and G81 are enabled and the AND gates 29 and 93 are disabled.

Accordingly, the full adders 27 and 91 in the LSI L1 respectively sum the amplitude data and the envelope data transferred serially from the LSI L2 and the amplitude data and the envelope data generated in LSI L1.

Conversely, the full adders 27 and 91 in the LSI L2 merely produce data inputted through the input terminals B thereof.

FIGS. 3(*g*) and 3(*h*) illustrate a change of the data D0 outputted from the latch 11 and a change of the data E0 outputted from the latch 83. In this way, in the LSI L1, the resultant data when the data of the LSIs L1 and L2 are summed is loaded into the latches 33 to 48 and 97 to 99, in response to the clock $\phi$16 shown in FIG. 3(*d*).

The amplitude data and the envelope data (upper 3 bit data) loaded into the latches 33 to 48 and 97 to 99 are held in the next cycle from times t0 to t15 and during this period the musical tone data is compressed.

The clock $\phi$L is produced from the AND gate 112 on the basis of the 3-bit data stored in the latches 97 to 99, as shown in Table 2. This clock is illustrated in FIG. 3(*i*). If the contents of the latches 97 to 99 take any values, the clock $\phi$L is produced at a time point of the timing signal t15, as shown in FIGS. 3(*i*-1) to 3(*i*-4), and the output signals from the latches 33 to 48 are stored in the latches 49 to 64.

Subsequently, every time the output of the clock $\phi$1 is "1", the contents of the latches 49 to 64 are progressively shifted toward upper bits. As seen from Table 2 and FIG. 3(*i*), if the value of the envelope is large, that is, the contents of the latches 99 to 97 are "1 ××", no shift of the contents of the latches 49 to 64 is performed. However, if the contents are "0 1×", the contents are shifted by one bit. If the contents are "0 0 1", those are shifted by 2 bits. Further, if the contents are "0 0 0 ", those are shifted by 3 bits and the latches 49 to 64 hold their contents.

The data obtained by shifting the contents in accordance with the envelope value are latched by the latches 66 to 81 by the clock $\phi$16. At the same time, the latches 113 and 114 latch the 2-bit data outputted from the decoder 103 through the lines m5 and m6.

In this way, in the LSI L1, the amplitude data and the envelope data from the LSI L2, and the amplitude data and the envelope data generated by the LSI L1 are composed and outputted. That is, the 2-bit data representing the amplification factor obtained from the envelope data is supplied to the amplifier 4. The compressed data is supplied to the D/A converter 3 where it is converted into an analog signal which in turn is applied to the amplifier 4.

Figure 4:
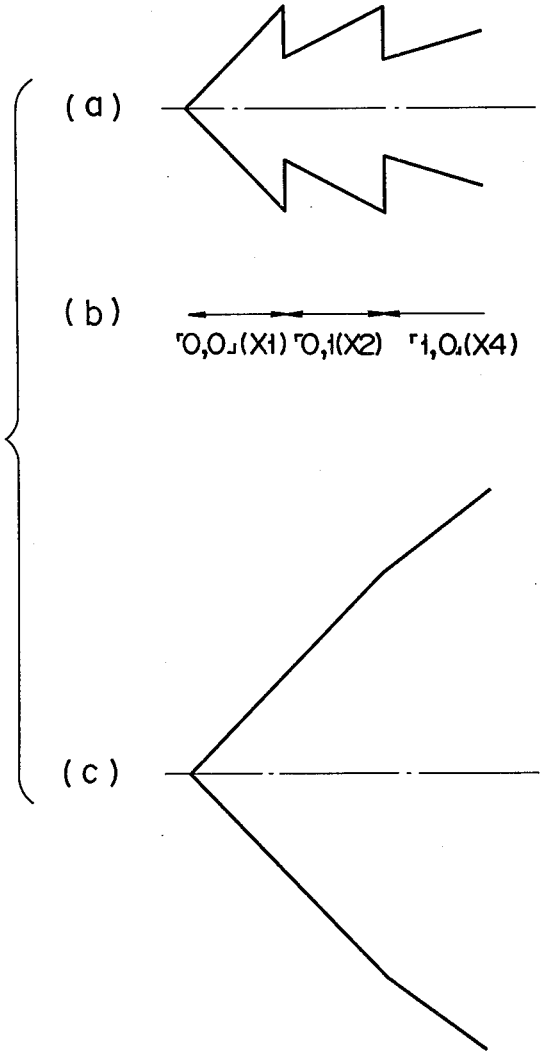
FIG. 4 is a diagram illustrating a change of an output sound volume according to the present invention.

As a result, in the amplifier 4, its amplification factor as shown in Table 3 is determined by the data from the terminals s0 and S1 and the amplifier 4 amplifies the input signal. As shown in FIG. 4, the 2-bit data to determine the amplification factor is "0, 0", that is to say, when four clocks $\phi$L are generated during the period from t0 to t15, the amplification factor is 1. Accordingly, when a level of the signal produced from the D/A converter 3, as shown in FIG. 4(*a*), a signal at the level as shown in FIG. 4(*c*) is produced from the amplifier 4 in a segment "0, 0" shown in FIG. 4(*b*).

When the output level gradually increases and the 2-bit data is "0, 1", that is to say, three clocks $\phi$L are generated during the period from t0 to t15, the amplification factor is 2. Therefore, in the section "0, 1" shown in FIG. 4(*b*), the output signal from the D/A converter 3 is doubled by the amplifier 4.

Similarly, everytime the amplification factor changes, a range of the D/A converter 3 changes to effect its correction, namely, the expansion.

Conversely, also when the sound volume gradually decreases, exactly the same control is of course performed.

In the present embodiment, the composed musical tone signals of the two LSIs L1 and L2 are compressed or expanded by the sum of the envelope data and is outputted as the musical tone signal.

Figure 5:
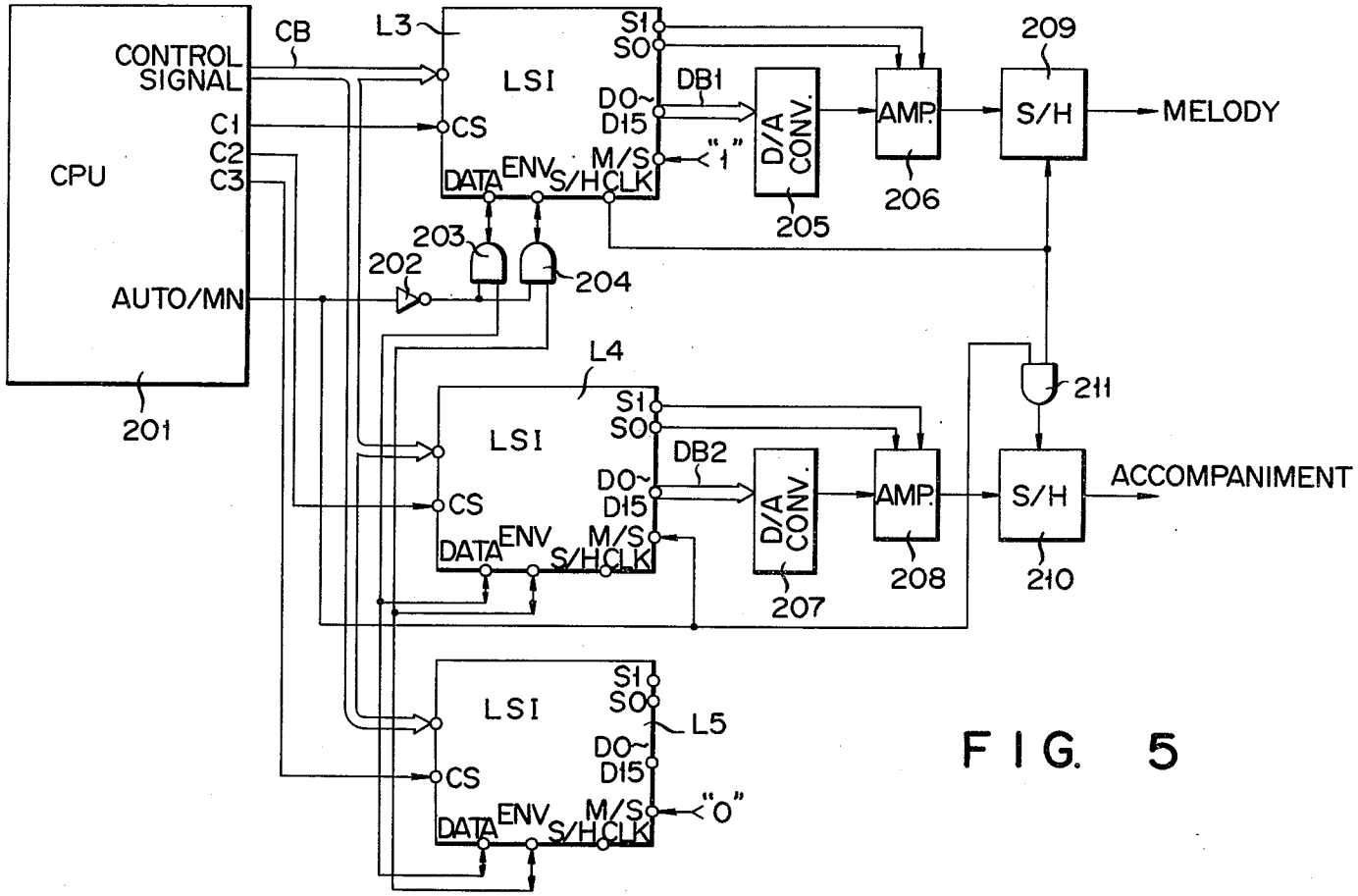
FIG. 5 is a block diagram showing an electrical arrangement of another embodiment of the present invention.

Another embodiment of a digital electronic musical instrument according to the present invention will be described referring to FIG. 5.

In the present embodiment, LSIs operating under control of a CPU 201 are three chips of LSI L3 to LSI L5. These LSIs L3 to L5 have much the same constructions and are the same as the LSIs L1 and L2 used in the first embodiment.

The LSI L3 generates a melody sound up to four chords and the LSI L4 generates the melody up to four chords or an accompaniment by switching a control signal AUTO/MN. The LSI L5 generates a single base sound. Specifically, the LSI L5 can generate chords up to four but can produce only one base sound.

A control signal is applied from the CPU 201 to these LSIs L3 to L5, through a control bus CB. When chip select signals C1 to C3 are logical "1", the corresponding chips are selected.

The control signal AUTO/MN is supplied to the master/slave terminal M/S of the LSI L4 and to AND gates 203 and 204 through an inverter 202. The LSI L4 applied musical tone data to the AND gate 203 through the terminal DATA. Envelope data is applied to the AND gate 204 via the terminal ENV. The output from the AND gate 203 is coupled with the terminal DATA of the LSI L3 and the output from the AND gate 204 is coupled with the terminal ENV of the LSI L3.

The AND gates 203, 204 are connected at their input terminals to the terminals DATA and ENV of the LSIs L4 and L5. A "0" signal is supplied to the master/slave terminal M/S of the LSI L5. For this reason, the LSI L5 is arranged so as to always transfer data to the LSI L4.

A "1" signal is always supplied to the master/slave terminal M/S of the LSI L3. For this reason, the LSI L3 composes signals (it may be a "0" signal) always supplied through the AND gates 203 and 204, and compreses the amplitude data for transmission to the D/A converter 205. The LSI L3 produces at the terminals S0 and S1 the 2-bit data to determine the amplification factor of the amplifier 206 to which the output signal from the D/A converter 205 is applied.

Similarly, the LSI L4 supplies the amplitude data to a D/A converter 207. The output signal from the D/A converter 207 is amplified, the amplifier 208, at the amplification factor determined by the 2-bit data supplied from LSI L4.

The LSI L3 produces at the terminal S/H CLK a sampling clock signal which in turn is applied directly to a sample/hold circuit 209 and through an AND gate 211 to another sample/hold circuit 210. The sample/hold circuits 209 and 210 are provided to prevent glitches in the output signal from the D/A converter. The sample/hold circuit 209 samples and holds the output signal from the amplifier 206 to transform it into a melody sound. The sample/hold circuit 210 samples and holds the output signal from the amplifier 208 to transform it into an accompaniment (containing the base). The sample/hold circuit 210 is supplied with the sampling clock only when the control signal AUTO/MN applied to the AND gate 211 is logical "1".

The operation of the above-mentioned embodiment will be described hereinafter. Table 4 illustrates how the LSIs L3 to L5 function when the control signal AUTO/MN is "0" and "1".

TABLE 4

| Control signal AUTO/MN | LSI L3 | LSI L4 | LIS L5 |
|---|---|---|---|
| "0" | Melody generation | Melody generation | |
| "1" | Melody generation | Accompaniment generation | Base generation |

As seen from Table 4, if the control signal AUTO/MN is "0", the data of the LSI L4 is transferred to the LSI L3 which in turn produces a melody sound of eight chords. In this case, the CPU 201 controls the LSI L5 so that it does not generate any musical tone. In other words, the CPU 201 allocates the musical tones of eight keys depressed to either of the LSI L3 and L4 for their generation purposes. Since a signal to enable the gate is not applied to the AND gate 211, the sample/hold circuit 210 is not operated and the output signal of the accompaniment is not produced.

When the control signal AUTO/MN is "1", the data representing a base sound from the LSI L5 is transferred to the LSI L4. The LSI L4 composes the data generated in the LSI L4 and the data transferred from the LSI L5 and produces the composed one. In this case the AND gates 203 and 204 are disabled, and therefore the LSI L3 merely produces a melody sound of up to four chords. Accordingly, the musical tones corresponding to melody keys of up to four musical tones are allocated to the LSI L3 where the musical tones are generated. The musical tones corresponding to the accompaniment keys of up to four musical tones are allocated to the LSI L4 where these are generated. The musical tones corresponding to the base keys or the musical tones (auto base) automatically selected and designated by operating the accompaniment keys are allocated to the LSI L5 where these are generated.

The data indicating what timbers form musical tones is supplied from the CPU 201 to the LSIs L3 to L5. The LSIs L3 to L5 form the musical tones in accordance with the data. Accordingly, the timber of the melody sound, the accompaniment and the base sound can be made different.

If the melody sound and the accompaniment containing the base sound are produced in the form of two series of musical tones (although not shown in FIG. 5), the output signals of the sample/hold circuits 209 can independently be controlled in the sound volumes and further characteristic filters can independently be applied for these output signals by external timber filters.

In the present embodiment, with mere provision of three chips of the LSIs L3 to L5, the melody sound of the same timber of up to 8 chords can be formed, and the melody sound of four chords, the accompaniment of four chords and the base sound of one sound.

In the above-mentioned embodiment, the musical tones of up to four chords can be generated, in a time-division manner, by a single LSI. It is evident that the number of chords can properly be changed. Further, it should be understood that the transfer of data among the LSIs can be performed not only in the serial manner but also in a parallel manner.

While in the above-mentioned embodiments input/output data terminals and the composing circuit are provided in each LSI, the input circuit or the output circuit, fabricated by the integrated circuit, may be provided separately from the LSI.

In the above-mentioned embodiments, data is transferred between the two chips, allowing the data composing processing. The data transfer may of course be performed among two or more chips. In this case, the data may be composed in a parallel manner with an increase of hardware. Alternatively, it may be done in a serial fashion with an increase of processing speed.

Further, the present invention is applicable for any type of musical instrument with the digital musical tone generating circuits, and the musical tone generating circuit is not necessarily limited to the one-chip LSI in its fabrication.

The circuit for data transfer, the circuit for expanding and compressing data, and the like may variously be modified within the scope of the present invention.

As having thus far been described, in the digital electronic musical instrument with a plurality of musical tone generating circuits, the musical tone data are composed, while at the same time the envelope data are composed. The musical tone data is compressed or expanded on the basis of the composed envelope data. The data is converted into an analog signal by the D/A converter, and then the analog data is amplified (expanded or compressed) by the amplifier on the basis of the envelope data. This gives us the musical tone signal. The necessary effect data is applied to the D/A converter. The low-bit D/A converter provides a high quality musical tone signal over a wide dynamic range. There is no need for providing D/A converters for each musical tone generating circuit. This results in decrease of the manufacturing cost, and enables the electronic musical instrument to be constructed with a small and simple circuit. Therefore, the musical instrument manufactured is compact in size and multifunctional.

When a number of LSI chips for each musical tone generating circuit are combined, the mass production of the LSIs is allowed. This leads to great reduction of the manufacturing cost and allows data to be transferred among the LSIs. Further, by expanding or compressing the musical tone data on the basis of the envelope data, the high quality musical tone can be formed by using only one D/A converter of small bit type.

What we claim is:

1. A digital electronic musical instrument comprising:

a plurality of musical tone generating means, each musical tone generating means generating digitized musical tone data representing a plurality of musical tones;

composing means for digitally composing said digitized musical tone data generated from all of said plurality of musical tone generating means;

operating means coupled to said composing means for selectively compressing or expanding the composed musical tone data in accordance with the composed musical tone data from all of said musical tone generating means; and output means including digital to analog converting means coupled to said operating means for converting the composed expanded or compressed musical tone data into an analog signal corresponding to a musical sound.

2. The digital electronic musical instrument of claim 1, wherein each of said musical tone generating means comprises a one chip semiconductor integrated circuit; and said composing means is contained in said semiconductor integrated circuit of a predetermined one of said chips; and said composing means of said one predetermined chip is coupled to receive said digitized musical tone data transferred from another of said chips for composing the digitized musical tone data transferred and the digitized musical tone data generated in said one predetermined chip.

3. The digital electronic musical instrument of claim 1 or 2, wherein said musical tone generating means includes means for generating said digitized musical tone data representing a plurality of musical tones in a time division manner.

4. The digital electronic musical instrument of claim 1 or 2, wherein said composing means comprises an adder and composes said digitized musical tone data by digitally adding said digitized musical tone data.

5. A digital electronic musical instrument comprising:

a plurality of musical tone generating means, each musical tone generating means including means for generating digitized musical tone data and digital envelope data, the digitized musical tone data being envelope-controlled in accordance with said digital envelope data;

first composing means for digitally composing said digitized musical tone data generated from all of said plurality of musical tone generating means;

second composing means for digitally composing said digital envelope data generated from all of said plurality of musical tone generating means;

setting means for setting compressing or expanding levels in accordance with the composed envelope data produced from said second composing means;

operating means for compressing or expanding the composed musical tone data from said first composing means in accordance with said compressing or expanding level set by said setting means;

digital to analog converting means;

means for supplying the compressed or expanded digitized musical tone data output from said operating means to said digital to analog converting means; and amplifying means for amplifying an output signal from said digital to analog converting means as a function of said compressing or expanding level set by said setting means to thereby effect compression or expansion of said output signal.

6. The digital electronic musical instrument of claim 5, wherein each of said musical tone generating means comprises a one chip semiconductor integrated circuit; and said first and second composing means are contained in said semiconductor integrated circuit of a predetermined one of said chips; said first composing means of said one predetermined chip is coupled to receive said digital envelope data from another of said chips for composing the digital envelope data transferred and the digital envelope data generated in said one predetermined chip; and said second composing means of said one predetermined chip is coupled to receive said digitized musical tone data from another of said chips for composing the digitized musical tone data transferred and the digitized musical tone data generated in said one predetermined chip.

7. The digital electronic musical instrument of claim 5 or 6, wherein each of said musical tone generating means includes means for generating said digitized musical tone data representing a plurality of musical tones in a time division manner.

8. The digital electronic musical instrument of claim 5 or 6, wherein each of said first and second composing means comprises an adder; said first composing means composes said digitized musical tone data by digitally adding said digitized musical tone data; and said second composing means composes said digital envelope data by digitally adding said digital envelope data.

9. A digital electronic musical instrument comprising a plurality of musical tone generating means, each generating digitized musical tone data and digital envelope data, the digitized musical tone data being envelope-controlled in accordance with said digital envelope data, said musical instrument comprising:

first composing means for composing said digital envelope data produced from all of said plurality of said musical tone generating means;

second composing means for composing said digitized musical tone data produced from all of said plurality of said musical tone generating means;

setting means for setting a bit shift level in accordance with the composed envelope data produced from said first composing means;

bit shift means for compressing or expanding the composed musical tone data produced from said second composing means in accordance with said shift level set by said setting means and for outputting compressed or expanded digitized musical tone data;

a digital to analog converting means supplied with the digitized compressed or expanded musical tone data output from said bit shift means; and amplifying means coupled to said digital to analog converting means for amplifying an output signal from said digital to analog converting means as a function of said shift level set by said setting means to thereby effect compression or expansion of said output signal.

10. The digital electronic musical instrument of claim 9, wherein each of said musical tone generating means comprises a one chip semiconductor integrated circuit; and said first and second composing means are contained in said semiconductor integrated circuit of a predetermined one of said chips; said first composing means of said one predetermined chip is coupled to receive said digital envelope data from another of said chips for composing the digital envelope data transferred and the digital envelope data generated in said one predetermined chip; and said second composing means of said one predetermined chip is coupled to receive said digitized musical tone data from another of said chips for composing the digitized musical tone data transferred and the digitized musical tone data generated in said one predetermined chip.

* * * * *

UNITED STATES PATENT AND TRADEMARK OFFICE

CERTIFICATE OF CORRECTION

PATENT NO. : 4,437,377

DATED : March 20, 1984

INVENTOR(S) : Tsuyoshi MITARAI, et al

It is certified that error appears in the above-identified patent and that said Letters Patent is hereby corrected as shown below:

COLUMN 11 (Claim 6), line 63, after "said chips; said" change "first" to --second--;

COLUMN 12 (Claim 6), line 2, after "predetermined chip; and said" change "second" to --first--.

COLUMN 1, line 17, before "musical tone generating" change "In the" to --The--.

Signed and Sealed this

*Nineteenth* Day of *February 1985*

[SEAL]

*Attest:*

DONALD J. QUIGG

*Attesting Officer* *Acting Commissioner of Patents and Trademarks*